US007008334B2

(12) United States Patent
Watanabe et al.

(10) Patent No.: US 7,008,334 B2
(45) Date of Patent: Mar. 7, 2006

(54) GOLF BALL

(75) Inventors: Hideo Watanabe, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/823,798

(22) Filed: Apr. 14, 2004

(65) Prior Publication Data

US 2005/0233834 A1 Oct. 20, 2005

(51) Int. Cl.
*A63B 37/12* (2006.01)

(52) U.S. Cl. ..... 473/378

(58) Field of Classification Search ..... 473/378, 473/351, 368, 367
See application file for complete search history.

(56) References Cited

U.S. PATENT DOCUMENTS

| | | | | |
|---|---|---|---|---|
| 5,645,496 | A * | 7/1997 | Endo et al. | 473/372 |
| 5,792,009 | A * | 8/1998 | Maruko | 473/359 |
| 5,830,085 | A | 11/1998 | Higuchi et al. | |
| 5,830,086 | A * | 11/1998 | Hayashi et al. | 473/376 |
| 5,967,908 | A | 10/1999 | Yamagishi et al. | |
| 6,194,505 | B1 | 2/2001 | Sone | |
| 2002/0183135 | A1 * | 12/2002 | Tsunoda et al. | 473/332 |
| 2003/0125136 | A1 | 7/2003 | Iwami | |

FOREIGN PATENT DOCUMENTS

| | | | |
|---|---|---|---|
| JP | 09-313643 | A | 12/1997 |
| JP | 10-305114 | A | 11/1998 |
| JP | 11-35633 | A | 2/1999 |
| JP | 11-164912 | A | 6/1999 |
| JP | 2002-293996 | A | 10/2002 |
| JP | 2003-175128 | A | 6/2003 |

* cited by examiner

*Primary Examiner*—Raeann Gorden
(74) *Attorney, Agent, or Firm*—Sughrue Mion, PLLC

(57) ABSTRACT

A golf ball comprising a core and a multilayer cover including at least a cover inner layer and a cover outer layer is characterized in that the core has a hardness corresponding to a compressive deflection amount of at least 3.5 mm when the load applied thereto is increased from an initial load of 10 kgf to a final load of 130 kgf, the cover outer layer is made of a resin composition having organic short fibers incorporated therein, the resin composition has a melt flow rate of at least 3 as measured according to JIS K7210, the cover outer layer has a Shore D hardness of at least 55 and is harder than the cover inner layer, and the cover outer layer has a gage of up to 1.4 mm. The golf ball has a soft feel, offers superior flight performance to even those golf players with a low head speed of 35 m/s or less, and is improved in durability to repeated impact and moldability.

9 Claims, 1 Drawing Sheet

GOLF BALL

BACKGROUND OF THE INVENTION

This invention relates to a golf ball having a soft feel on impact, which offers superior flight performance to even those golf players who swing a driver (W#1) at a low head speed (HS) of 35 m/s or less, and is improved in durability to repeated impact and moldability.

In order for the golf ball to present a soft feel on impact, the core must be made relatively soft. Development works on golf balls have been made not only for high head speeds, but also for low head speeds. For the prior art golf balls intended for low head speeds, a soft feel was obtained at the sacrifice of travel distance. It was difficult to find a good compromise between travel distance and feel.

More specifically, low head speed golf players, who wish to increase the travel distance, tend to use a driver (W#1) having a larger loft angle than high head speed golf players. In this situation, when the ball is hit, the ball launches at a larger angle and receives more spin, which results in a reduction of travel distance. An attempt was thus made to increase the travel distance of the ball by designing a ball structure having a soft core enclosed with a thin cover for thereby minimizing the spin rate of the ball.

For example, JP-A 9-313643 and JP-A 10-305114 disclose golf balls of three-layer structure comprising a core, an intermediate layer and a cover. These golf balls, however, do not intend to improve moldability from the standpoint of cover stock flow, and they fail to provide the satisfactory property of travel distance when hit at low head speeds.

Also, JP-A 2003-175128 discloses a golf ball comprising a cover in which a ternary composite material consisting of rubber, polyolefin and nylon components is admixed with an olefinic resin. In this golf ball, however, the durability to repeated impact of the cover is insufficiently improved.

SUMMARY OF THE INVENTION

The present invention is made under the above-discussed circumstances and its object is to provide a golf ball having a soft feel which offers superior flight performance to even those golf players who swing a driver (W#1) at a low head speed (HS) of 35 m/s or less, and is improved in durability to repeated impact and moldability.

Making extensive investigations to attain the above object on a multi-piece solid golf ball having a softened core and a multilayer cover including a thinned cover outermost layer, intending to enhance the fluidity of a resin composition for the cover outermost layer in order to overcome the problem of molding defects induced during injection molding of the thin cover, and paying attention to the core hardness, cover outermost layer hardness and the melt flow rate of the cover outermost layer resin composition in order to prevent any degradation of durability to repeated impact inherent to the thin cover, the inventors have found that a golf ball characterized in that said core has a hardness corresponding to a compressive deflection amount of at least 3.5 mm when the load applied thereto is increased from an initial load of 10 kgf to a final load of 130 kgf, said cover outer layer is made of a resin composition having organic short fibers incorporated therein, said resin composition has a melt flow rate of at least 3 as measured according to JIS K7210, said cover outer layer has a Shore D hardness of at least 55 and is harder than said cover inner layer, and said cover outer layer has a gage of up to 1.4 mm has a soft feel, offers superior flight performance to even those golf players with a low head speed of 35 m/s or less, and is improved in durability to repeated impact and moldability. The present invention is predicated on this finding. In particular, finding that by adding a binary copolymer consisting of polyolefin and polyamide components to the base resin in the cover, even the cover which is as thin as 1.4 mm or less is significantly improved in durability to repeated impact, the inventors have completed the present invention.

Accordingly, the present invention provides a golf ball as defined below.

[1] A golf ball comprising a core and a multilayer cover including at least a cover inner layer and a cover outer layer, characterized in that said core has a hardness corresponding to a compressive deflection amount of at least 3.5 mm when the load applied thereto is increased from an initial load of 10 kgf to a final load of 130 kgf, said cover outer layer is made of a resin composition having organic short fibers incorporated therein, said resin composition has a melt flow rate of at least 3 as measured according to JIS K7210, said cover outer layer has a Shore D hardness of at least 55 and is harder than said cover inner layer, and said cover outer layer has a gage of up to 1.4 mm.

[2] The golf ball of [1], wherein the resin composition of which said cover outer layer is made comprises (a) at least one component selected from the group consisting of olefin-unsaturated carboxylic acid copolymers, olefin-unsaturated carboxylic acid-unsaturated carboxylic acid ester copolymers, and metal ion-neutralized products of these copolymers and (b) a binary copolymer consisting of polyolefin and polyamide components in admixture as a resin component.

[3] The golf ball of [2], wherein the polyamide in component (b) is in fiber form.

[4] The golf ball of [2], wherein a weight ratio of (a)/(b) is between 100/0.1 and 100/50.

[5] The golf ball of [2], wherein in component (b), a weight ratio of polyolefin/polyamide components is between 25/75 and 95/5.

The present invention uses a cover composed of plural layers for the following reason. In the event the ball structure is a two-layer structure consisting of a core and a single layer cover, since support pins are used for holding the core during injection molding, interfaces reaching the core are formed in the wake of support pins, adversely affecting durability to repeated impact. By contrast, in the event the ball is formed with two or more cover layers, the interfaces terminate within one cover layer and do not reach the core, whereby durability to repeated impact is improved. In particular, from the standpoints of improving the feel in short game and on putter shots and further ameliorating durability to repeated impact, the present invention has taken into account the requirement that the cover inner layer be softer than the cover outer layer.

DETAILED DESCRIPTION OF THE INVENTION

Figure 1:
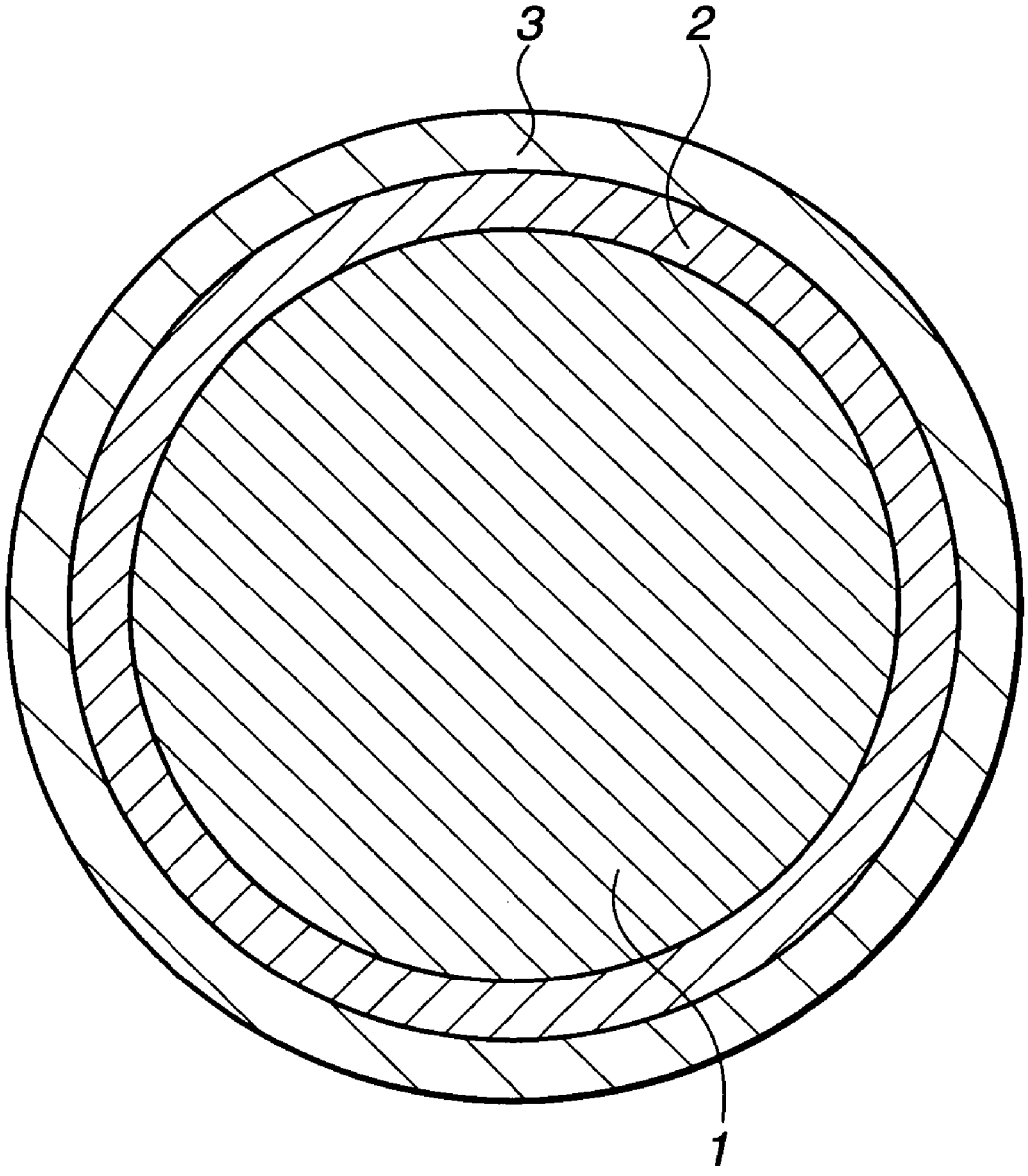
FIG. 1 is a schematic cross-sectional view of a golf ball in one embodiment of the invention.

Now the invention is described in detail.

The golf ball of the invention having a multilayer cover including at least a cover inner layer and a cover outer layer is embodied, for example, as a three-piece ball structure consisting of a single layer core 1, a cover inner layer 2, and a cover outer layer 3 as shown in FIG. 1.

The solid core may be formed of a rubber composition containing, for example, a co-crosslinking agent, an organic peroxide, an inert filler, an organosulfur compound and the like. The base rubber used in the rubber composition is preferably polybutadiene.

The polybutadiene as the rubber component preferably has a cis-1,4 unit content on the polymer chain of at least 60 wt %, more preferably at least 80 wt %, even more preferably at least 90 wt %, and most preferably at least 95 wt %. A polybutadiene having too low a cis-1,4 unit content in the molecule may lower the resilience.

Moreover, the polybutadiene has a 1,2-vinyl unit content on the polymer chain of generally not more than 2%, preferably not more than 1.7%, and even more preferably not more than 1.5%. Too high a 1,2-vinyl unit content may lower the resilience.

To obtain a molded and vulcanized rubber composition of good resilience, the polybutadiene used herein is preferably synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the invention, the use of a neodymium catalyst in which a neodymium compound serves as the lanthanide series rare-earth compound is advantageous because it enables a polybutadiene rubber having a high cis-1,4 unit content and a low 1,2-vinyl unit content to be obtained at an excellent polymerization activity. Preferred illustrative examples of such rare-earth catalysts include those mentioned in JP-A 11-35633, JP-A 11-164912 and JP-A 2002-293996.

In the rubber component, the polybutadiene synthesized using the lanthanide series rare-earth compound based catalyst is preferably contained in an amount of at least 10 wt %, more preferably at least 20 wt %, and most preferably at least 40 wt %, for improving resilience.

Rubber components other than the above-described polybutadiene may be included in the base rubber, insofar as the objects of the invention are not compromised. Examples of such additional rubber components other than the above-described polybutadiene include polybutadienes other than the above-described polybutadiene, and other diene rubbers, such as styrene-butadiene rubbers, natural rubbers, isoprene rubbers and ethylene-propylene-diene rubbers.

Examples of the co-crosslinking agent include unsaturated carboxylic acids and metal salts of unsaturated carboxylic acids.

Examples of unsaturated carboxylic acids include acrylic acid, methacrylic acid, maleic acid and fumaric acid. Inter alia, acrylic acid and methacrylic acid are preferred.

The metal salts of unsaturated carboxylic acids include, but are not limited to, the above-described unsaturated fatty acids neutralized with desired metal ions. Illustrative are zinc and magnesium salts of methacrylic and acrylic acids. Inter alia, zinc acrylate is most preferred.

The unsaturated carboxylic acid and/or metal salt thereof is generally incorporated in an amount per 100 parts by weight of the base rubber of at least 10 parts by weight, preferably at least 15 parts by weight, more preferably at least 20 parts by weight, and as an upper limit, up to 60 parts by weight, preferably up to 50 parts by weight, more preferably up to 45 parts by weight, most preferably up to 40 parts by weight. Too large an amount may result in too high a hardness and an unacceptable feel on impact whereas too small an amount may lead to a decline of resilience.

Commercial products may be used as the organic peroxide. For example, Percumil D (by NOF Corporation), Perhexa 3M (by NOF Corporation) and Luperco 231XL (by Atochem Co.) may be advantageously used. These peroxides may be used alone or in admixture.

The organic peroxide is generally incorporated in an amount per 100 parts by weight of the base rubber of at least 0.1 part by weight, preferably at least 0.3 part by weight, more preferably at least 0.5 part by weight, most preferably at least 0.7 part by weight, and as an upper limit, up to 5 parts by weight, preferably up to 4 parts by weight, more preferably up to 3 parts by weight, most preferably up to 2 parts by weight. Too large or too small an amount may fail to provide a satisfactory feel, durability and resilience.

Examples of the inert filler used include zinc oxide, barium sulfate and calcium carbonate. They may be used alone or in admixture.

The inert filler is generally incorporated in an amount per 100 parts by weight of the base rubber of at least 1 part by weight, preferably at least 5 parts by weight, and as an upper limit, up to 50 parts by weight, preferably up to 40 parts by weight, more preferably up to 30 parts by weight, most preferably up to 20 parts by weight. Too large or too small an amount may fail to provide an adequate weight and a satisfactory resilience.

If necessary, an antioxidant may be incorporated. Commercially available antioxidants are, for example, Nocrac NS-6 and NS-30 (by Ouchi Shinko Chemical Industry Co., Ltd.), and Yoshinox 425 (by Yoshitomi Pharmaceutical Industries, Ltd.). They may be used alone or in admixture.

The antioxidant is generally incorporated in an amount per 100 parts by weight of the base rubber of at least 0 part by weight, preferably at least 0.05 part by weight, more preferably at least 0.1 part by weight, most preferably at least 0.2 part by weight, and as an upper limit, up to 3 parts by weight, preferably up to 2 parts by weight, more preferably up to 1 part by weight, most preferably up to 0.5 part by weight. Too large or too small an amount may fail to provide a satisfactory resilience and durability.

In the core, an organosulfur compound is preferably incorporated in order to improve the rebound and increase the initial velocity of the golf ball.

The organosulfur compound is not particularly limited as long as it can improve the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; diphenylpolysulfides, dibenzylpolysulfides, dibenzoylpolysulfides, dibenzothiazoylpolysulfides and dithiobenzoylpolysulfides having 2 to 4 sulfurs. Inter alia, the zinc salt of pentachlorothiophenol and diphenyldisulfide are preferred.

The organosulfur compound is generally incorporated in an amount per 100 parts by weight of the base rubber of at least 0.05 part by weight, preferably at least 0.1 part by weight, and as an upper limit, up to 5 parts by weight, preferably up to 4 parts by weight, more preferably up to 3 parts by weight, most preferably up to 2.5 parts by weight. If the addition amount is too large, its effect may plateau, with no further effect being ascertained. With too small an amount, the addition effect may not be fully exerted.

Preferably the core has a diameter of usually at least 36.7 mm, especially at least 37.0 mm, and as an upper limit, usually up to 40.5 mm, especially up to 38.5 mm. The weight is usually 30 to 36 grams, preferably 31 to 34 grams.

Within the above-defined diameter range, the core used herein should have a compressive deflection amount, when the load applied thereto is increased from an initial load of 10 kgf to a final load of 130 kgf, of at least 3.5 mm, preferably at least 4.0 mm, more preferably at least 4.3 mm, and up to 6.0 mm, preferably up to 5.5 mm, more preferably up to 4.7 mm, the deflection amount being referred to as hardness (10–130 kgf). Too small a deflection amount leads to a hard feel on impact. Additionally, the spin rate is increased so that the travel distance on shots with a driver (W#1) at a low head speed or with an iron may be reduced. Inversely, with too large a deflection amount, crack durability to repeated impact is worsened and too low resilience fails to provide a travel distance.

As the resin composition of which the cover inner layer is made, any well-known synthetic resin may be used without a particular limitation. The preferred resin composition is a composition comprising:

(A) an ionomer resin comprising (a-1) an olefin-unsaturated carboxylic acid binary random copolymer and/or a metal ion-neutralized product of an olefin-unsaturated carboxylic acid binary random copolymer and (a-2) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer in a proportion (a-1)/(a-2) between 100/0 and 0/100 in weight ratio, and (B) a non-ionomeric thermoplastic elastomer in a proportion (A)/(B) between 100/0 and 50/50 in weight ratio; and more preferably, a mixture comprising:

100 parts by weight of a resin component comprising (A) the aforementioned ionomer resin and (B) the aforementioned non-ionomeric thermoplastic elastomer in a proportion (A)/(B) between 100/0 and 50/50 in weight ratio, (C) 5 to 80 parts by weight of an organic fatty acid and/or derivative thereof having a molecular weight of 280 to 1,500, and (D) 0.1 to 10 parts by weight of a basic inorganic metal compound capable of neutralizing un-neutralized acid groups in the resin component and component (C).

The olefins in components (a-1) and (a-2) have a number of carbons that is generally at least 2, and as an upper limit not more than 8, and preferably not more than 6. Examples of such olefins include ethylene, propylene, butene, pentene, hexene, heptene and octene. Ethylene is especially preferred.

Illustrative examples of the unsaturated carboxylic acid include acrylic acid, methacrylic acid, maleic acid and fumaric acid. Acrylic acid and methacrylic acid are especially preferred.

The unsaturated carboxylic acid ester in component (a-2) is preferably a lower alkyl ester of the foregoing unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid binary random copolymer as component (a-1) and the olefin-unsaturated carboxylic acid-unsaturated carboxylic acid ester ternary random copolymer as component (a-2) (these copolymers are sometimes referred to collectively as "random copolymers," hereinafter) can each be obtained by subjecting the above-described olefin, unsaturated carboxylic acid and optionally, unsaturated carboxylic acid ester to random copolymerization in a well-known way.

It is recommended that the random copolymers have a controlled content of unsaturated carboxylic acid (acid content). The content of unsaturated carboxylic acid in component (a-1) is generally at least 4 wt %, preferably at least 6 wt %, more preferably at least 8 wt %, and most preferably at least 10 wt %, and as an upper limit, generally not more than 30 wt %, preferably not more than 20 wt %, more preferably not more than 18 wt %, and most preferably not more than 15 wt %. The content of unsaturated carboxylic acid in component (a-2) is generally at least 4 wt %, preferably at least 6 wt %, more preferably at least 8 wt %, and as an upper limit, generally not more than 15 wt %, preferably not more than 12 wt %, more preferably not more than 10 wt %.

If component (a-1) and/or (a-2) has too low an unsaturated carboxylic acid content, rebound may decline. Too high an acid content may lower processability.

The metal ion-neutralized product of an olefin-unsaturated carboxylic acid binary random copolymer as component (a-1) and the metal ion-neutralized product of an olefin-unsaturated carboxylic acid-unsaturated carboxylic acid ester ternary random copolymer as component (a-2)

(these neutralized products are sometimes referred to collectively as "metal ion-neutralized products of random copolymers," hereinafter) can each be obtained by neutralizing some or all of the acid groups on the random copolymer with metal ions.

Illustrative examples of metal ions for neutralizing the acid groups on the random copolymer include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. Preferred metal ions include $Na^+$, $Li^+$, $Zn^{2+}$ and $Mg^{2+}$. The use of $Na^+$ is especially recommended from the standpoint of resilience improvement.

The method of obtaining the metal ion-neutralized products of random copolymers may be by adding suitable compounds of the above metal ions, for example, formates, acetates, nitrates, carbonates, hydrogencarbonates, oxides, hydroxides or alkoxides of the above metal ions to the random copolymers having acid groups. The degree of neutralization of acid groups with metal ions is not particularly limited in the practice of the invention.

Commercial products may be used as the above-described components (a-1) and (a-2).

Examples of the random copolymer as component (a-1) include Nucrel 1560, 1214 and 1035 (all products of DuPont-Mitsui Polychemicals Co., Ltd.); and ESCOR 5200, 5100 and 5000 (all products of EXXONMOBIL CHEMICAL).

Examples of the metal ion-neutralized product of random copolymer as component (a-1) include Himilan 1554, 1557, 1601, 1605, 1706 and AM7311 (all products of DuPont-Mitsui Polychemicals Co., Ltd.), Surlyn 7930 (produced by E.I. DuPont de Nemours and Co., Inc.) and Iotek 3110 and 4200 (both products of EXXONMOBIL CHEMICAL).

Examples of the random copolymer as component (a-2) include Nucrel AN4311 and AN4318 (both products of DuPont-Mitsui Polychemicals Co., Ltd.); and ESCOR ATX325, ATX320 and ATX310 (all products of EXXONMOBIL CHEMICAL).

Examples of the metal ion-neutralized product of random copolymer as component (a-2) include Himilan 1855, 1856 and AM7316 (all products of DuPont-Mitsui Polychemicals Co., Ltd.), Surlyn 6320, 8320, 9320 and 8120 (all products of E.I. DuPont de Nemours and Co., Inc.), and Iotek 7510 and 7520 (both products of EXXONMOBIL CHEMICAL). For each component, these products may be used alone or in admixture.

The zinc-neutralized ionomer resins that can be preferably used as the above metal ion-neutralized product of random copolymer include Himilan 1706, 1557 and AM7316.

The proportion of component (a-2) relative to the sum of components (a-1) and (a-2) is usually at least 0% by weight, preferably at least 50% by weight, and as an upper limit, usually up to 100% by weight.

Component (B) is a non-ionomeric thermoplastic elastomer which is preferably included to further enhance both the feel of the golf ball upon impact and its rebound characteristics. In the invention, the above-described ionomer resin (A) and non-ionomeric thermoplastic elastomer (B) are sometimes referred to collectively as the "resin component."

Specific examples of the non-ionomeric thermoplastic elastomer (B) include olefin elastomers, styrene elastomers, polyester elastomers, urethane elastomers and polyamide elastomers. The use of an olefin elastomer or a polyester elastomer is preferred for further increasing resilience.

Commercial products may be used as component (B) and include olefin elastomers such as Dynaron (manufactured by JSR Corporation) and polyester elastomers such as Hytrel (manufactured by DuPont-Toray Co., Ltd.). These products may be used alone or in admixture.

The proportion of component (B) in the resin component is usually at least 0% by weight, preferably at least 20% by weight, and as an upper limit, usually up to 50% by weight, preferably up to 40% by weight. A proportion of component (B) in the resin component in excess of 50% by weight may lower the compatibility of the components and markedly compromise the durability of the golf ball.

Component (C) used herein is an organic fatty acid and/or derivative thereof having a molecular weight of 280 to 1,500. This component is advantageously included because it has a very low molecular weight compared with the base resin and is used to adjust the melt viscosity of the mixture to a suitable level, particularly to help improve flow.

The organic fatty acid as component (C) has a molecular weight of usually at least 280, preferably at least 300, more preferably at least 330, and most preferably at least 360, and as an upper limit, usually up to 1,500, preferably up to 1,000, more preferably up to 600, and most preferably up to 500. Too low a molecular weight may lead to a poor heat resistance, whereas too high a molecular weight may make it impossible to improve flow.

Preferred examples of the organic fatty acid serving as component (C) include unsaturated organic fatty acids having a double bond or triple bond on the alkyl group and saturated organic fatty acids in which all the bonds on the alkyl group are single bonds.

It is recommended that the number of carbons on the molecule of the organic fatty acid be generally at least 18, preferably at least 20, more preferably at least 22, and most preferably at least 24, and as an upper limit, up to 80, preferably up to 60, more preferably up to 40, and most preferably up to 30. Too few carbons may lead to a poor heat resistance and may also make the content of acid groups so high as to diminish the flow-enhancing effect on account of interactions between acid groups in the fatty acid and acid groups in the base resin. On the other hand, too many carbons increases the molecular weight, which may also prevent the desired flow-enhancing effect from being fully achieved.

Specific examples of organic fatty acids which are used herein as component (C) include 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

The organic fatty acid derivatives as component (C) include metallic soaps in which the proton on the acid group of the above-mentioned organic fatty acid has been substituted with a metal ion. Metal ions that may be used in such metallic soaps include $Na^+$, $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of the organic fatty acid derivatives as component (C) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. These may be used alone or in admixture.

The amount of component (C) included per 100 parts by weight of the resin component is usually at least 5 parts by weight, preferably at least 10 parts by weight, more preferably at least 15 parts by weight, even more preferably at least 18 parts by weight, and as an upper limit, usually up to 80 parts by weight, preferably up to 40 parts by weight, more preferably up to 25 parts by weight, even more preferably up to 22 parts by weight. Too small an amount of component (C) may lead to too low a melt viscosity and hence, a decline of processability. Too large an amount of component (C) may lead to a decline of durability.

Alternatively, in the practice of the invention, known metallic soap-modified ionomers (see U.S. Pat. No. 5,312,857, U.S. Pat. No. 5,306,760 and WO 98/46671) can be used as the combination of the ionomer resin (A) with above component (C).

Component (D) used herein is a basic inorganic metal compound which can neutralize un-neutralized acid groups in the resin component and component (C). In the event a metallic soap-modified ionomer resin is used alone in the absence of component (D), the metallic soap and the un-neutralized acid groups present on the ionomer resin undergo exchange reactions during mixture under heating, permitting a large amount of fatty acid to generate and vaporize. This may cause failures including molding defects, a decline of coating adhesion, and a decline of the resilience of molded parts. These considerations recommend to include component (D) in the invention.

It is recommended that component (D) be the compound which has a high reactivity with the resin component and produces no organic acids as reaction by-products.

Illustrative examples of the metal ions in component (D) include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ and $Co^{2+}$, which may be used alone or in admixture. Known basic inorganic fillers containing these metal ions may be used as component (D). Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. A hydroxide or a monoxide is recommended. Calcium hydroxide and magnesium oxide, both of which have a high reactivity with the base resin, are preferred.

The amount of component (D) included per 100 parts by weight of the resin component is usually at least 0.1 part by weight, preferably at least 0.5 part by weight, more preferably at least 1 part by weight, even more preferably at least 2 parts by weight, and as an upper limit, usually up to 10 parts by weight, preferably up to 8 parts by weight, more preferably up to 6 parts by weight, even more preferably up to 5 parts by weight. Too little component (D) may fail to achieve significant improvements in thermal stability and resilience, whereas too much instead may lower the heat resistance of the golf ball-forming material due to the presence of excess basic inorganic metal compound.

It is noted that the mixture which is obtained by combining the foregoing components (A) to (D) has a degree of neutralization of usually at least 50 mol %, preferably at least 60 mol %, more preferably at least 70 mol %, and most preferably at least 80 mol %, based on the total amount of acid groups in the mixture. Such a high degree of neutralization is effective, for example, even on use of a metal soap-modified ionomer resin, for preventing exchange reactions from readily occurring between the metal soap and un-neutralized acid groups on the ionomer resin during heat mixing, thus minimizing the risk of degrading thermal stability, moldability and resilience.

In the cover inner layer of the invention, additives such as pigments, dispersants, antioxidants, UV absorbers and light stabilizers may be included in addition to the foregoing components (A) to (D). The amount of such additives included is not particularly limited and they are incorporated in an amount, per 100 parts by weight of the resin component consisting of components (A) and (B), of usually at least 0.1 part by weight, preferably at least 0.5 part by weight, and more preferably at least 1 part by weight, and as an upper limit, usually up to 10 parts by weight, preferably up to 6 parts by weight, and more preferably up to 4 parts by weight.

The cover inner layer may be obtained by heating and mixing the above-described components, for example, by milling on an internal mixer such as a kneading-type twin-screw extruder, a Banbury mixer or a kneader at a heating temperature of 150 to 250° C.

On the other hand, as the resin composition for the cover outer layer in the invention, any well-known synthetic resin may be used without a particular limitation. Preferably the cover outer layer is formed of a resin composition comprising as essential components:

(a) a component selected from among olefin-unsaturated carboxylic acid copolymers, olefin-unsaturated carboxylic acid-unsaturated carboxylic acid ester copolymers, and metal ion-neutralized products of these copolymers and (b) a binary copolymer consisting of polyolefin and polyamide components.

Component (a) is selected from among olefin-unsaturated carboxylic acid binary random copolymers, metal ion-neutralized products of olefin-unsaturated carboxylic acid binary random copolymers, olefin-unsaturated carboxylic acid-unsaturated carboxylic acid ester ternary random copolymers, and metal ion-neutralized products of olefin-unsaturated carboxylic acid-unsaturated carboxylic acid ester ternary random copolymers. The olefins in the copolymers are preferably those having at least 2 carbon atoms, but not more than 8, and especially not more than 6 carbon atoms. Specific examples include ethylene, propylene, butene, pentene, hexene, heptene and octene. Ethylene is especially preferred.

The unsaturated carboxylic acid is exemplified by acrylic acid, methacrylic acid, maleic acid and fumaric acid. Acrylic acid and methacrylic acid are especially preferred.

The unsaturated carboxylic acid esters are preferably lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) are especially preferred.

The olefin-unsaturated carboxylic acid binary random copolymers and olefin-unsaturated carboxylic acid-unsaturated carboxylic acid ester ternary random copolymers serving as component (a) herein can be obtained by adjusting the above-described materials and effecting random copolymerization by a well-known method.

It is recommended that the random copolymer have a controlled content of unsaturated carboxylic acid (acid content). It is recommended that the unsaturated carboxylic acid content within the random copolymer serving as component (a) be generally at least 4 wt %, preferably at least 6 wt %, more preferably at least 8 wt %, and most preferably at least 10 wt %, and as an upper limit, generally not more than 30 wt %, preferably not more than 20 wt %, more preferably not more than 18 wt %, and most preferably not more than 15 wt %.

The metal ion-neutralized products of olefin-unsaturated carboxylic acid binary random copolymers and metal ion-neutralized products of olefin-unsaturated carboxylic acid-unsaturated carboxylic acid ester ternary random copolymers serving as component (a) (the metal ion-neutralized products of these copolymers are collectively referred to as metal ion-neutralized products of random copolymers) can be obtained by partially neutralizing acid groups on the random copolymer with metal ions.

Illustrative examples of metal ions for neutralizing the acid groups include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. Preferred metal ions include $Na^+$, $Li^+$, $Zn^{2+}$, and $Mg^{2+}$, with $Zn^{2+}$ being especially preferred.

In producing the metal ion-neutralized products of random copolymers, the random copolymers may be neutralized with the metal ions. For example, a neutralizing method using suitable compounds of the metal ions, such as formates, acetates, nitrates, carbonates, hydrogencarbonates, oxides, hydroxides and alkoxides may be employed. The degree of neutralization of the random copolymer with the metal ions is not particularly limited.

Of the metal ion-neutralized products of random copolymers used herein, zinc ion-neutralized ionomer resins are preferred because they are effective for increasing the melt flow rate of the material for adjusting to an optimum melt flow rate to be described later, and improving moldability.

Commercial products may be used as component (a). Specifically, commercial products of the binary random copolymer include Nucrel 1560, 1214 and 1035 (all products of DuPont-Mitsui Polychemicals Co., Ltd.) and ESCOR 5200, 5100 and 5000 (all products of EXXONMOBIL CHEMICAL); and commercial products of the ternary random copolymer include Nucrel AN4311 and AN4318 (all products of DuPont-Mitsui Polychemicals Co., Ltd.) and ESCOR ATX325, ATX320 and ATX310 (all products of EXXONMOBIL CHEMICAL).

Additionally, commercial products of the metal ion-neutralized product of binary random copolymer include Himilan 1554, 1557, 1601, 1605, 1706 and AM7311 (all products of DuPont-Mitsui Polychemicals Co., Ltd.), Surlyn 7930 (E.I. DuPont de Nemours and Company), and Iotek 3110 and 4200 (all products of EXXONMOBIL CHEMICAL); and commercial products of the metal ion-neutralized product of ternary random copolymer include Himilan 1855, 1856 and AM7316 (all products of DuPont-Mitsui Polychemicals Co., Ltd.), Surlyn 6320, 8320, 9320 and 8120 (E.I. DuPont de Nemours and Company), and Iotek 7510 and 7520 (all products of EXXONMOBIL CHEMICAL). Examples of the zinc neutralized ionomer resins which are preferred among the metal ion-neutralized products of random copolymers include Himilan 1706, 1557 and AM7316.

In component (b), the polyolefin component may be selected from low-density polyethylene (LDPE), high-density polyethylene (HDPE), polypropylene, polystyrene and the like. Of these, polyethylene, especially low-density polyethylene having high crystallinity is preferred.

For the polyamide component, use may be made of nylon 6, nylon 66, nylon 11, nylon 12, nylon 610, nylon 612, copolymerized nylon, nylon MXD6, nylon 46, aramid, polyamide-imide, polyimide and the like. Nylon 6 is preferred from a balance of physical properties and cost. The polyamide component preferably takes the form of fibers, with nylon fibers being especially preferred. It is preferred that the nylon fibers have an average diameter of up to 10 $\mu$m, more preferably up to 5 $\mu$m, even more preferably up to 1 $\mu$m, but at least 0.01 $\mu$m because better reinforcement effects are developed for a certain amount blended. It is noted that the average diameter is a measurement from observation of a sample cross-section under a transmission electron microscope.

The preferred form of component (b) in the invention is a crystalline polyolefin component bound to surfaces of nylon fibers. As used herein, the term "bound" means that the polyamide and polyolefin components are graft linked by adding a binder. The binders used herein include silane coupling agents, titanate coupling agents, unsaturated carboxylic acids, unsaturated carboxylic acid derivatives, organic peroxides and the like.

In component (b), polyolefin component (b-1) and polyamide component (b-2) are preferably blended in a weight ratio (b-1)/(b-2) between 25/75 and 95/5, more preferably between 30/70 and 90/10, and even more preferably between 40/60 and 75/25. Too little polyamide component fails to exert sufficient reinforcing effects. Too much polyamide component makes it difficult to mix with component (a) during kneading on a twin screw extruder or the like.

Also, components (a) and (b) are preferably blended in a weight ratio (a)/(b) between 100/0.1 and 100/50, more preferably between 100/1 and 100/40, even more preferably between 100/2 and 100/30. Too less a blending amount fails to exert sufficient effects. Too much a blending amount interferes with kneading or molding into a golf ball cover.

The temperature at which components (a) and (b) are kneaded is preferably equal to or higher than the melting point of polyolefin component, more preferably at least 10°

C. higher than the melting point of polyolefin component, and equal to or lower than the melting point of the polyamide component, more preferably at least 10° C. lower than the melting point of polyamide component, in order to maintain the shape of polyamide component as intact as possible. However, the kneading temperature is not necessarily limited to this range.

The temperature of the resin when molded into a golf ball is also preferably in the above-defined temperature range, but may be higher if necessary.

In the resin composition comprising components (a) and (b) as essential components, various additives may be blended in addition to the resin components, if necessary. Such additives include, for example, pigments, dispersants, antioxidants, UV absorbers, UV stabilizers, parting agents, plasticizers, and inorganic fillers (zinc oxide, barium sulfate, titanium dioxide, etc.). It is preferred that components (a) and (b) be included in a total amount of at least 30% by weight, especially 60 to 100% by weight in the resin composition in order to achieve the desired effects of the invention.

It is noted that the cover outer layer formed using the resin composition has a Shore D hardness of at least 55, preferably at least 57, and more preferably at least 59. If the Shore D hardness of the cover is too low, rebound becomes poor, with short flight distance. Also, the cover outer layer has a Shore D hardness of up to 65, preferably up to 63, and more preferably up to 61. If the Shore D hardness of the cover is too high, durability to cracking by repeated impact may be exacerbated. It is noted that the Shore D hardness of the cover is a measurement by a type D durometer according to ASTM D2240.

Also, with respect to the gage of the cover outer layer, the upper limit is 1.4 mm, preferably 1.3 mm and more preferably 1.2 mm. Beyond the upper limit, the spin rate of the ball when hit with a driver (W#1) may not be suppressed, failing to travel a distance. The lower limit of the cover gage is 0.5 mm, preferably 0.9 mm, and more preferably 1.1 mm. Below the lower limit, durability to cracking by repeated impact may be exacerbated.

In the practice of the invention, the cover resin composition for the cover outer layer should have a melt flow rate of at least 3, preferably at least 4, more preferably at least 4.5, as measured according to JIS K7210 (1999). If the melt flow rate of the cover resin composition is below the lower limit, the permeation of molten resin through the mold cavity during injection molding may be impeded, resulting in molding defects. It is noted that the measurement according to JIS K7210 (1999) indicates a melt flow rate of the cover resin composition as measured under conditions: test temperature 190° C. and test load 21.2 N (2.16 kgf).

The total gage of the cover is generally in a range of 1.5 to 3.0 mm, preferably 2.0 to 2.8 mm, more preferably 2.4 to 2.6 mm. If the total gage of the cover is too thin, durability to cracking by repeated impact may be exacerbated. If the total gage of the cover is too thick, the spin rate on driver (W#1) shots may increase, sometimes failing to travel a distance.

According to the invention, the hardness of the cover outer layer is set higher than that of the cover inner layer. The hardness difference between the cover outer layer and the cover inner layer is preferably at least 1, more preferably at least 3, even more preferably at least 5 Shore D hardness units. With too small a hardness difference, the feel on impact may be exacerbated and the spin rate on driver (W#1) shots may increase, failing to travel a distance. The upper limit of hardness difference is preferably up to 25, more preferably up to 20, even more preferably up to 15. With too large a hardness difference, durability to cracking by repeated impact may be exacerbated.

According to the invention, the cover consists of plural layers including at least a cover inner layer and a cover outer layer. If necessary, one or more additional cover layer may be provided between the cover inner layer and the cover outer layer. The materials of which the additional cover layer is made include thermoplastic resins and thermoplastic elastomers, typically well-known ionomer resins. The gage and hardness of the additional cover layer may be suitably determined insofar as the subject matter of the invention is not altered.

The golf balls of the invention for competition use are in accord with the Rules of Golf and typically formed to a diameter of 42.60 to 42.80 mm and a weight of 45.0 to 45.93 g.

EXAMPLE

Examples and Comparative Examples are shown below for illustrating the invention, but the invention is not limited to the Examples.

Examples and Comparative Examples

Using the core formulation and vulcanizing method shown in Table 1, solid cores were prepared in Examples and Comparative Examples. The solid core of each Example was determined for an amount of compressive deflection incurred when the applied load was increased from an initial load of 10 kgf to a final load of 130 kgf, hardness (10–130 kgf).

TABLE 1

| | Example | | | Comparative Example | | | | | |
|---|---|---|---|---|---|---|---|---|---|
| | 1 | 2 | 3 | 1 | 2 | 3 | 4 | 5 | 6 |
| Core formulation (pbw) | | | | | | | | | |
| Polybutadiene*1 | 100 | 100 | 100 | 100 | 100 | 100 | 100 | 100 | 100 |
| Zinc acrylate | 25.3 | 23.3 | 21.3 | 21.3 | 25.3 | 25.3 | 21.3 | 25.3 | 30 |

TABLE 1-continued

| | Example | | | Comparative Example | | | | | |
|---|---|---|---|---|---|---|---|---|---|
| | 1 | 2 | 3 | 1 | 2 | 3 | 4 | 5 | 6 |
| Organic peroxide-1*2 | 0.3 | 0.3 | 0.3 | 0.3 | 0.3 | 0.3 | 0.3 | 0.3 | 0.3 |
| Organic peroxide-2*3 | 0.3 | 0.3 | 0.3 | 0.3 | 0.3 | 0.3 | 0.3 | 0.3 | 0.3 |
| Antioxidant*4 | 0.1 | 0.1 | 0.1 | 0.1 | 0.1 | 0.1 | 0.1 | 0.1 | 0.1 |
| Zinc oxide | 27.9 | 28.6 | 29.4 | 29.4 | 27.9 | 27.9 | 29.4 | 33.2 | 25.0 |
| Zinc salt of pentachlorothiophenol | 0.1 | 0.1 | 0.1 | 0.1 | 0.1 | 0.1 | 0.1 | 0.1 | 0 |
| Zinc stearate | 5 | 5 | 5 | 5 | 5 | 5 | 5 | 5 | 5 |
| Vulcanization (temp./time) | 155° C./ 15 min | 155° C./ 15 min | 155° C./ 15 min | 155° C./ 15 min | 155° C./ 15 min | 155° C./ 15 min | 155° C./ 15 min | 155° C./ 15 min | 155° C./ 15 min |

Note:
*1Polybutadiene: BR730 (Nd catalyst), by JSR Corp.
*2Organic peroxide-1: dicumyl peroxide, Percumil D (trade name, by NOF Corp.)
*3Organic peroxide-2: 1,1-bis(t-butylperoxy)-3,3,5-trimethylcyclohexane, Perhexa 3M-40 (trade name, by NOF Corp.)
*4antioxidant: Nocrac NS-6 (trade name, by Ouchi Shinko Chemical Industry Co., Ltd.)

Next, the solid core of each Example or Comparative Example was enclosed with a cover inner layer and a cover outer layer each made of a cover resin composition of formulation A to F in Table 2 and having a predetermined gage, obtaining a three-piece solid golf ball. These balls were examined for moldability, flight performance, feel on impact, and durability to repeated impact by the tests described below. The results are shown in Table 3.

TABLE 2

| Component (pbw) | A | B | C | D | E | F |
|---|---|---|---|---|---|---|
| Surlyn 8120*1 | 75 | | | | | |
| Surlyn 7930*1 | | | | 37 | | |
| Surlyn 6320*1 | | | | 40 | | |
| Himilan 1557*2 | | 50 | 50 | | 50 | 50 |
| Himilan 1555*2 | | 50 | 50 | | | |
| Himilan 1601*2 | | | | | 50 | 50 |
| Nucrel AN4318*3 | | | | 23 | | |
| Dynaron E6100P*4 | 25 | | | | | |
| Polyolefin/polyamide binary copolymer*5 | | 5 | | | | 5 |
| Behenic acid*6 | 20 | | | | | |
| Calcium hydroxide*7 | 2.3 | | | | | |
| Titanium oxide | | 2 | 2 | 2 | 2 | 2 |
| Magnesium stearate | | 1 | 2 | 1 | 1 | 1 |
| Melt flow rate (MFR)*8 | 2.1 | 4.8 | 5.1 | 4 | 2.1 | 2 |

Note:
*1Ionomer resins by E. I. Dupont
*2Ionomer resins by Dupont-Mitsui Polychemicals Co., Ltd.
*3ethylene-methacrylic acid-acrylic acid ester ternary copolymer by Dupont-Mitsui Polychemicals Co., Ltd.
*4hydrogenated block copolymer polybutadiene by JSR Corp.
*5LA0010 by Yamato Polymer Co., Ltd., polyolefin (low-density polyethylene)/polyamide (nylon 6) short fiber ratio = 100/100 in weight ratio
*6NAA222-S beads by NOF Corp.
*7CLS-B by Shiraishi Kogyo Kaisha Ltd.
*8melt flow rate of material as measured according to JIS K7210 (1999), that is, under conditions: test temperature 190° C. and test load 21.2 N (2.16 kgf).

Moldability

In the step of enclosing the core with the cover by injection molding, it was examined how smoothly the cover resin composition permeated through the mold cavity. Specifically, moldability was judged by whether or not weld lines were visually inspected near the vents.

○: When 100 balls were molded, the number of balls on which weld lines were visually inspected was 10 or less.

X: When 100 balls were molded, the number of balls on which weld lines were visually inspected was 16 or more.

Flight Performance

Using a hitting robot equipped with a club, each ball was hit at a head speed of 30 m/s and a total travel distance was measured. The total travel distance was an average computed from the distances of 10 balls.

○: total distance equal to or more than 120 m

X: total distance less than 120 m

Feel

Ten amateur golfers who swing a driver (W#1) at a head speed of 30 to 35 m/s examined the feel of the ball when hit with W#1. The ball was evaluated according to the following criterion.

○: 7 or more of ten golfers ascertained a soft good feel

X: 7 or more of ten golfers ascertained a hard feel

Durability to Repeated Impact

The ball was repeatedly hit at a head speed of 35 m/s. The number of hits when the ball started cracking was counted and reported as an index based on a number of hits of 100 for Example 3.

○: index equal to or more than 100

X: index equal to or less than 90

TABLE 3

| | | Example | | | Comparative Example | | | | | |
|---|---|---|---|---|---|---|---|---|---|---|
| | | 1 | 2 | 3 | 1 | 2 | 3 | 4 | 5 | 6 |
| Core | Outer diameter (mm) | 37.7 | 37.7 | 37.7 | 37.7 | 37.7 | 37.7 | 37.7 | 36.1 | 37.7 |
| | Hardness (10–130 kgf) (mm) | 3.9 | 4.2 | 4.7 | 4.7 | 3.9 | 3.9 | 4.7 | 3.9 | 3.0 |
| Cover inner layer | Material | A | A | A | A | E | A | A | A | A |
| | Shore D hardness in sheet | 51 | 51 | 51 | 51 | 60 | 51 | 51 | 51 | 51 |
| | Gage (mm) | 1.3 | 1.3 | 1.3 | 1.3 | 1.3 | 1.3 | 1.3 | 1.3 | 1.3 |
| Outer diameter of sphere (core + cover inner layer) (mm) | | 40.3 | 40.3 | 40.3 | 40.3 | 40.3 | 40.3 | 40.3 | 38.7 | 40.3 |
| Cover outer layer | Material | B | B | B | C | D | D | F | B | B |
| | Shore D hardness in sheet | 60 | 60 | 60 | 60 | 50 | 50 | 60 | 60 | 60 |
| | Gage (mm) | 1.2 | 1.2 | 1.2 | 1.2 | 1.2 | 1.2 | 1.2 | 2.0 | 1.2 |
| Total gage of cover (inner + outer layers) (mm) | | 2.5 | 2.5 | 2.5 | 2.5 | 2.5 | 2.5 | 2.5 | 3.3 | 2.5 |
| Ball | Outer diameter (mm) | 42.7 | 42.7 | 42.7 | 42.7 | 42.7 | 42.7 | 42.7 | 42.7 | 42.7 |
| | Weight (g) | 45.4 | 45.4 | 45.4 | 45.4 | 45.4 | 45.4 | 45.4 | 45.4 | 45.4 |
| Moldability | | ○ | ○ | ○ | ○ | ○ | ○ | X | ○ | ○ |
| Flight performance | Spin (rpm) | 3647 | 3586 | 3483 | 3491 | 4011 | 4144 | 3483 | 3717 | 3816 |
| | Total (m) | 120.3 | 121.1 | 122.4 | 122.3 | 115.5 | 113.8 | 122.4 | 119.4 | 119.5 |
| | Rating | ○ | ○ | ○ | ○ | X | X | ○ | X | X |
| Feel | | ○ | ○ | ○ | ○ | ○ | ○ | ○ | ○ | X |
| Durability to repeated impact (index) | | ○ | ○ | ○ | X | ○ | ○ | ○ | ○ | ○ |

It is seen from the results of Table 3 that the golf balls of Examples have a soft feel, offer superior flight performance when golf players with a low head speed of 35 m/s or less play, and are improved in durability to repeated impact and moldability.

By contrast, Comparative Example 1 is less durable to repeated impact since the cover has no organic short fibers incorporated therein. The ball of Comparative Example 2, in which the cover outer layer is softer than the cover inner layer, receives too much spin and travels short distance. The ball of Comparative Example 3, in which the cover outer layer is too soft, receives too much spin and travels short distance. In Comparative Example 4, the cover outer layer has too poor a flow to injection mold. The ball of Comparative Example 5, in which the cover outer layer is too thick, receives too much spin and travels short distance. The ball of Comparative Example 6, in which the core has too high a hardness, gives a bad feel, receives a too much spin rate and travels short distance.

The invention claimed is:

1. A golf ball comprising a core and a multilayer cover including at least a cover inner layer and a cover outer layer, wherein said core has a hardness corresponding to a compressive deflection amount of at least 3.5 mm when the load applied thereto is increased from an initial load of 10 kgf to a final load of 130 kgf, said cover outer layer is made of a resin composition having organic short fibers incorporated therein, said resin composition has a melt flow rate of at least 3 as measured according to JIS K7210, said cover outer layer has a Shore D hardness of at least 55 and is harder than said cover inner layer, and said cover outer layer has a gage of up to 1.4 mm, and wherein the resin composition of which said cover outer layer is made comprises (a) at least one component selected from the group consisting of olefin-unsaturated carboxylic acid copolymers, olefin-unsaturated carboxylic acid-unsaturated carboxylic acid ester copolymers, and metal ion-neutralized products of these copolymers and (b) a binary copolymer consisting of polyolefin and polyamide components in admixture as a resin component.

2. The golf ball of claim 1, wherein the polyamide in component (b) is in fiber form.

3. The golf ball of claim 1, wherein a weight ratio of (a)/(b) is between 100/0.1 and 100/50.

4. The golf ball of claim 1, wherein in component (b), a weight ratio of polyolefin/polyamide components is between 25/75 and 95/5.

5. A golf ball comprising a core and a multilayer cover including at least a cover inner layer and a cover outer layer, wherein said core is formed of a rubber composition containing polybutadiene synthesized with a rare-earth catalyst as base rubber, and the core has a hardness corresponding to a compressive deflection amount of at least 3.5 mm when the load applied thereto is increased from an initial load of 10 kgf to a final load of 130 kgf, said cover outer layer is made of a resin composition having organic short fibers incorporated therein, said resin composition has a melt flow rate of at least 4 as measured according to JIS K7210, said cover outer layer has a Shore D hardness of at least 55 and is harder than said cover inner layer, and said cover outer layer has a gage of up to 1.4 mm.

6. The golf ball of claim 5, wherein said core contains an organosulfur compound or organosulfur compounds.

7. The golf ball of claim 5, wherein the melt flow rate of said resin composition is at least 4.5.

8. A golf ball comprising a core and a multilayer cover including at least a cover inner layer and a cover outer layer, wherein said core comprises an organosulfur compound or organosulfur compounds and has a hardness corresponding to a compressive deflection amount of at least 3.5 mm when the load applied thereto is increased from an initial load of 10 kgf to a final load of 130 kgf, said cover outer layer is made of a resin composition having organic short fibers incorporated therein, said resin composition has a melt flow rate of at least 4 as measured according to JIS K7210, said cover outer layer has a Shore D hardness of at least 55 and is harder than said cover inner layer, and said cover outer layer has a gage of up to 1.4 mm.

9. The golf ball of claim 8, wherein the melt flow rate of said resin composition is at least 4.5.

* * * * *